US006544031B2

(12) United States Patent
Li et al.

(10) Patent No.: US 6,544,031 B2
(45) Date of Patent: Apr. 8, 2003

(54) BURNER ASSEMBLY WITH ENHANCED BTU OUTPUT AND FLAME STABILITY

(76) Inventors: Ceji Li, 125 Glengarry Dr., Bloomingdale, IL (US) 60168-2611; Qin-Lai Yu, 7338 Crain St., Niles, IL (US) 60714

( * ) Notice: Subject to any disclaimer, the term of this patent is extended or adjusted under 35 U.S.C. 154(b) by 0 days.

(21) Appl. No.: 10/033,817

(22) Filed: Dec. 20, 2001

(65) Prior Publication Data

US 2002/0090588 A1 Jul. 11, 2002

Related U.S. Application Data

(62) Division of application No. 09/631,084, filed on Aug. 2, 2000.

(51) Int. Cl.[7] ..... F23Q 14/26
(52) U.S. Cl. ..... 431/266; 431/353
(58) Field of Search ..... 431/263–266, 431/353

(56) References Cited

U.S. PATENT DOCUMENTS 1,209,261 A 12/1916 Challiner
2,465,155 A * 3/1949 Higley ..... 431/174
2,860,695 A * 11/1958 Lake ..... 431/266
3,469,790 A 9/1969 Duncan
3,700,173 A 10/1972 Ketchum, Jr.
5,494,437 A 2/1996 Kubota et al.
5,984,665 A 11/1999 Loftus et al.
6,041,838 A 3/2000 Al-Sabah
6,048,196 A * 4/2000 Collier et al. ..... 431/265
6,345,979 B1 * 2/2002 Taylor et al. ..... 431/266

FOREIGN PATENT DOCUMENTS

GB 1304794 A 1/1973
JP 6-221528 8/1994

* cited by examiner

*Primary Examiner*—Sara Clarke
(74) *Attorney, Agent, or Firm*—Marshall, Gerstein & Borun

(57) ABSTRACT

A burner assembly having improved BTU output, flame stability and starting reliability is provided. The burner includes a retention plate at an output end of a gas supply line having a central hub from a which a plurality of spokes radially extend. The retention plate and gas supply line are provided within an outer sleeve of the burner. The retention plate occupies a relatively small cross-sectional area of the sleeve. Accordingly, large amounts of combustion air can be forced through the sleeve, with controlling air flow paths being created by apertures provided in each of the spokes. A pilot, including a circumferential spark gap, is provided to improve starting reliability.

4 Claims, 4 Drawing Sheets

BURNER ASSEMBLY WITH ENHANCED BTU OUTPUT AND FLAME STABILITY

This is a divisional patent application of U.S. application Ser. No. 09/631,084, filed Aug. 2, 2000.

FIELD OF THE INVENTION

The invention generally relates to gas burners and, more particularly, relates to gas burner assemblies.

BACKGROUND OF THE INVENTION

Burners which combust gas, such as propane and natural gas, are well known and widely applied. For example, boilers, furnaces, kilns, incinerators, dryers, and food processing equipment all commonly rely upon the heat generated by such combustion for proper operation.

Prior art burner designs have been created to mix a combustible gas with air and provide a spark for the purpose of starting. Extensive attention has been directed to finding proper mixing ratios and to creating apparatus for obtaining such ratios to most efficiently burn the gas while maximizing BTU output.

One known type of burner includes a substantially cylindrical housing provided with an inlet and an outlet. A motor connected to a blower or a fan wheel is typically connected to the inlet to direct air needed for combustion therethrough. A gas supply conduit typically enters the inlet end of the housing as well, and terminates in a gas nozzle short of the housing outlet end. The area of the housing downstream of the nozzle defines a combustion chamber. An ignition source, such as a spark plug or rod, is positioned proximate the gas nozzle and can be energized as needed.

In order to generate a desired airflow through the housing to the combustion chamber to obtain the desired BTU output and flame shape, various retention or nozzle plates have been created. Such plates are typically provided transverse to the longitudinal axis of the housing, and are positioned slightly upstream of the nozzle. The plates typically include various aperture designs to direct forced air therethrough and thus create desired characteristics in the resulting flame.

Two such characteristics are BTU output and flame stability. BTU output is a measure of the strength of the flame and its resulting heat output, and is a function of, among other things, the amounts of air and gas combined and the ratio at which they are combined. Flame stability relates to the maintainability and controllability of the flame. If the gas/air ratio becomes too rich or too lean, the flame can be lost or can burn inefficiently. If the flame is not suitably confined, shaped, and directed, BTU output may be detrimentally effected.

In light of the foregoing, various aperture sizes, aperture patterns, and angles of incidence have been employed in prior art retention plates. Moreover, to ensure starting reliability, relatively complex pilot assemblies have typically been employed. Such pilots require extensive machining and assembly time, resulting in an expensive pilot.

SUMMARY OF THE INVENTION

In accordance with one aspect of the invention, a burner assembly is provided which comprises a substantially cylindrical combustion chamber, a gas supply provided in the combustion chamber and terminating in the gas supply outlet, an air supply in fluid communication with the combustion chamber, and a flame stabilizing plate disposed in the substantially cylindrical combustion chamber. The flame stabilizing plate includes a central hub from which a plurality of spokes radially extend. Major combustion air openings are defined by adjacent spokes and the combustion chamber. Minor combustion air openings are provided in each of the plurality of spokes.

In accordance-with another aspect of the invention, a pilot assembly is provided which comprises a housing having a combustion chamber, a spark rod having an end plate disposed in the combustion chamber and spaced from an interior surface of the combustion chamber to form a circumferential sparking gap around the end plate, and a gas supply inlet in fluid communication with the combustion chamber.

In accordance with another aspect of the invention, a burner nozzle plate is provided which comprises a central hub, and a plurality of spokes extending radially from the central hub.

In accordance with another aspect of the invention, an improvement to a burner assembly of the type having a nozzle housing having an inlet and an outlet, a blower motor connected to the inlet, a gas supply conduit disposed in the nozzle housing, and a combustion chamber defined by the nozzle housing downstream of the gas supply conduit, is provided. The improvement comprises a nozzle plate disposed in the nozzle housing wherein the nozzle plate includes a central hub with a plurality of spokes radially extending therefrom, each spoke including at least one aperture, a plurality of major air pathways defined by adjacent spokes and the nozzle housing, and at least one minor air pathway defined by each of the spoke apertures.

These and other aspects and features of the invention will become more apparent from the following detailed description when taken in conjunction with the accompanying drawings.

Figure 1:
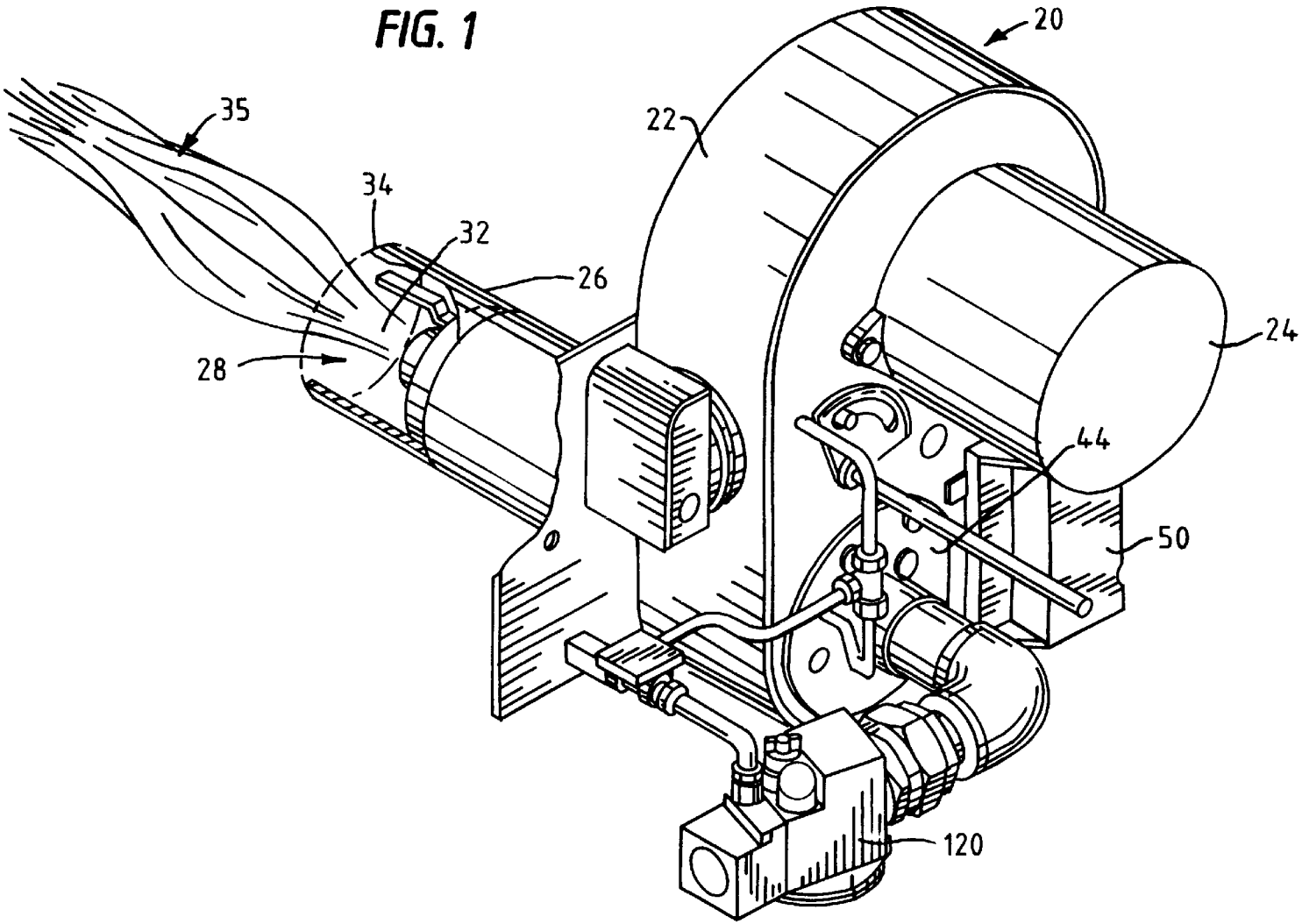
FIG. 1 is an isometric, partial cut-away, view of a burner assembly constructed in accordance with the teachings of the invention.

While the invention is susceptible to various modifications and alternative constructions, certain illustrative embodiments thereof have been shown in the drawings and will be described below in detail. It should be understood, however, that there is no intention to limit the invention to a specific form disclosed, but on the contrary, the intention is to cover all modifications, alternative constructions and equivalents falling within the spirit and the scope of the invention as defined by the appended claims.

DETAILED DESCRIPTION OF THE PREFERRED EMBODIMENTS

Referring now to the drawings, and with specific reference to FIG. 1, a burner constructed in accordance with the teachings of the invention is generally depicted by reference numeral 20. As shown therein, the burner 20 includes a housing 22 in which a blower fan (not shown) is adapted to rotate. The fan is powered by a motor 24. An air flow created by the blower fan is directed through a sleeve 26 which is shown to be substantially cylindrical in shape. A burner cartridge assembly 28 is disposed within the sleeve 26 to supply combustible gas and a source of ignition. The burner 20 is primarily directed to combustion of propane, but is to be understood that other gases, including but not limited to natural gas, can be employed.

A combustion chamber 32 is provided immediately upstream of an outlet 34 of the sleeve 26. Air and gas are mixed and ignited in the combustion chamber 32 as will be discussed in further detail herein. The resulting flame 35 is directed outwardly through the outlet 34 of the sleeve 26. The outlet 34 can be positioned proximate any suitable receiving conduit or chamber such as that provided in a boiler, furnace, heat exchanger, kiln or the like, to perform useful work therein.

Figure 2:
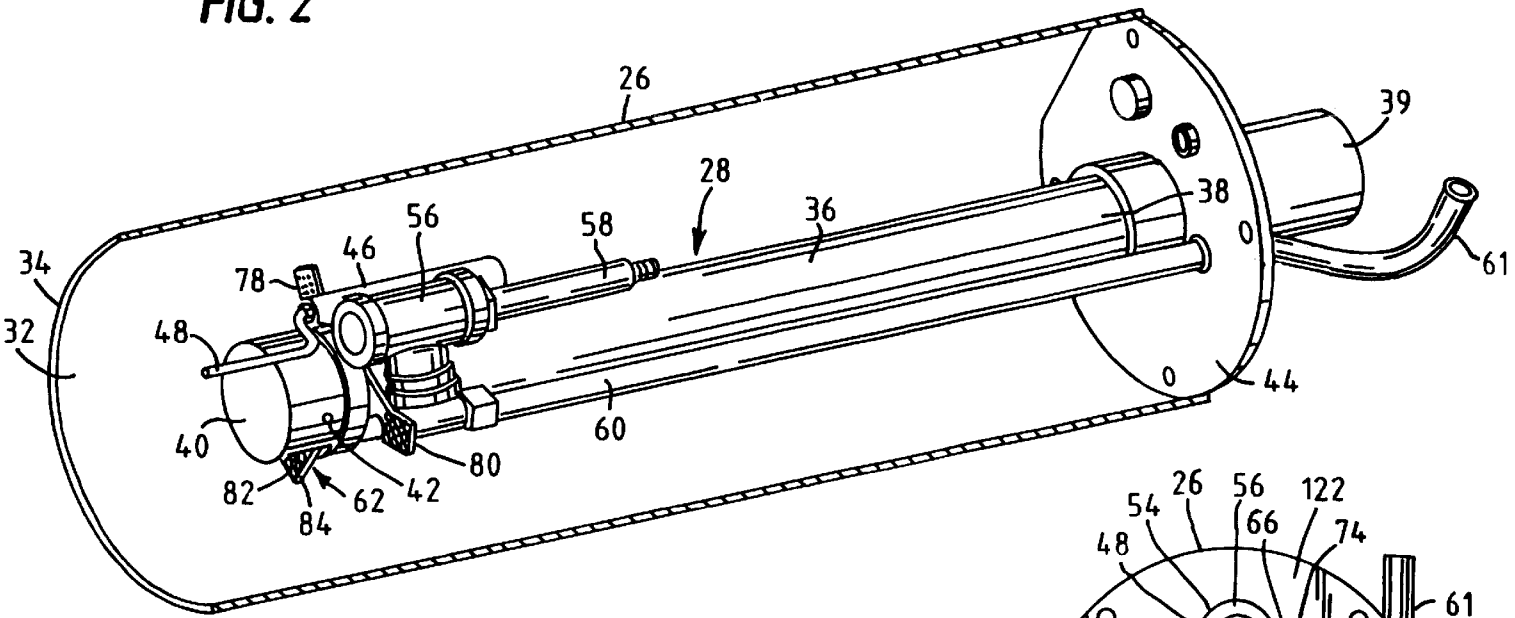
FIG. 2 is an isometric partial cut-away, view of the burner assembly shown in FIG. 1.

Turning now to FIG. 2, the burner cartridge 28 is shown in detail. Burner cartridge 28 includes a supply conduit 36 having an inlet 38, adapted to be connected to a supply of gas 39, and an outlet cap 40. In one preferred embodiment, the outlet cap 40 includes a plurality of radially directed apertures 42 through which the gas is dispersed. A back plate 44 is secured to the inlet 38 of the supply conduit 36 for attachment of the burner cartridge 28 to the housing 22.

A flame rod assembly 46 is positioned proximate the outlet end 40 of the supply conduit 36 to detect and ensure the presence of a flame. Such flame rod assemblies 46 are conventional and may operate by providing a flame rod 48 which, upon being heated by the flame, directs a suitable signal to a controller 50 (FIG. 1) of the burner 20. The controller 50 may be in communication with a higher level integrated control system which may take advantage of the signal to provide an indication to an operator as to whether a flame is present.

A pilot assembly 54 is also provided proximate the outlet end 40 of the supply conduit 36. The pilot assembly 54 provides initial ignition such that upon actuation of the motor 24, and flow of gas through the gas supply conduit 36 and the outlet cap 40, overall ignition of the burner 20 is insured. The pilot assembly 54 includes a housing 56, a spark rod 58 and a gas supply conduit 60 having an inlet 61, all of which will be described in further detail herein.

A flame retention or stabilizing plate 62 is also provided proximate the outlet cap 40 of the supply conduit 36. As shown best in FIGS. 3 and 4, the retention plate 62 includes a substantially triangular shaped central hub 64 having three sides 66, 68, and 70. The hub 64 also includes three corners 72, 74, and 76 from which legs or spokes 78, 80, and 82 radially extend, respectively. A plurality of apertures 84 are provided in each of the spokes 78, 80, and 82. In the preferred embodiment, nine such apertures 84 are provided in a substantially rectangular configuration, although a different number of apertures, or configuration for the apertures, can be employed.

While the retention plate 62 is illustrated with the hub 64 being substantially triangularly shaped with three substantially rectangularly shaped spokes 78, 80, 82 extending radially therefrom, it is to be understood that the teachings of the invention encompass additional shapes which employ differently shaped central hubs from which a plurality of differently shaped spokes radially extend. In addition, a larger or smaller number of spokes 78, 80, 82 may be provided in such alternative embodiments.

Figure 4:
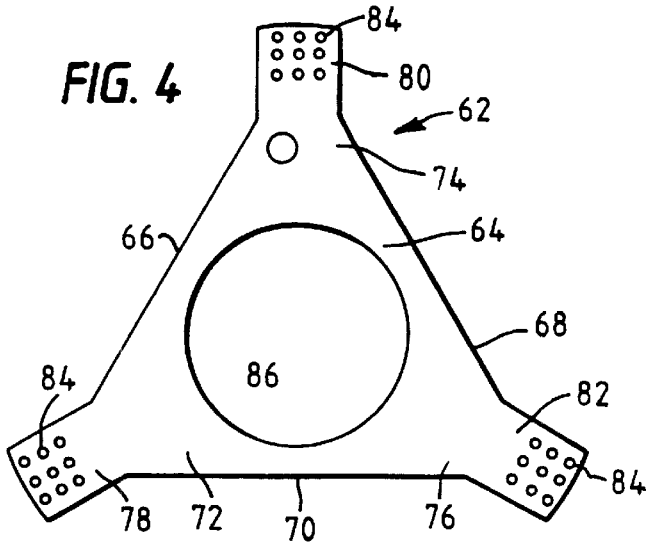
FIG. 4 is a plan view of a flame retention plate constructed in accordance with the teachings of the invention.

As shown in FIG. 4, the retention plate 62 also includes a large central aperture 86 which enables gas to flow therethrough when connected to the supply conduit 36. The retention plate 62 may be connected to the supply conduit 36 by welding, fasteners, or the like.

Figure 7:
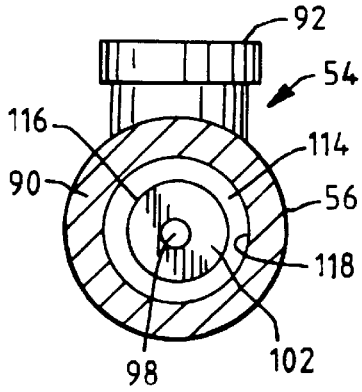
FIG. 7 is an end view of a pilot assembly constructed in accordance with the teachings of the invention.
Figure 5:
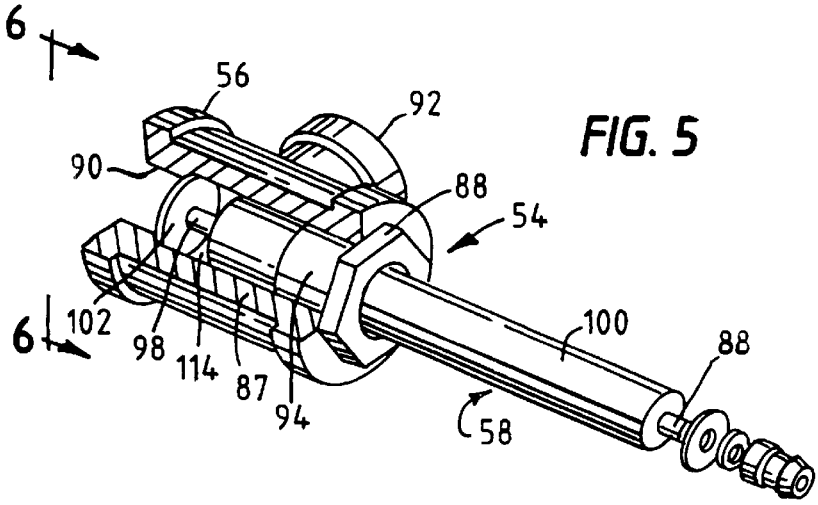
FIG. 5 is an isometric, partial cut-away, view of a pilot assembly constructed in accordance with the teachings of the invention.
Figure 6:
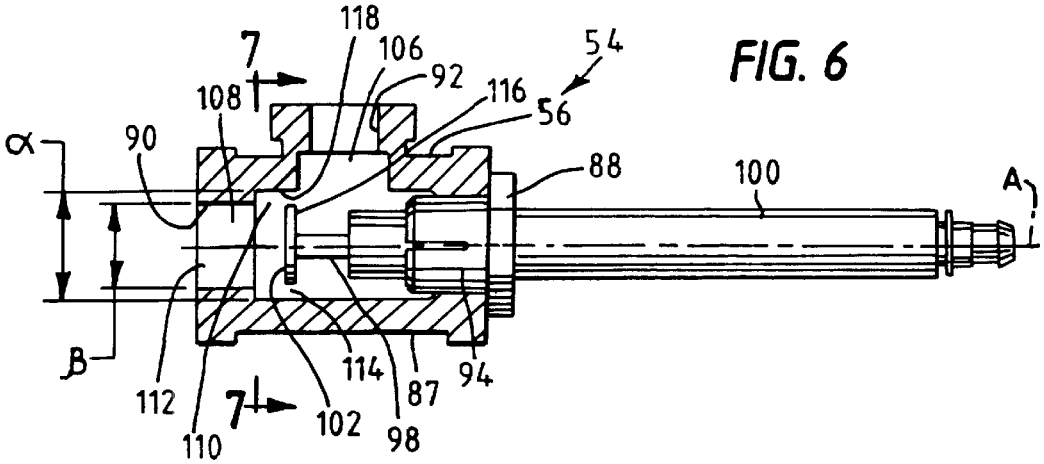
FIG. 6 is a sectional view of FIG. 5 taken generally along line 6—6 of FIG. 5.

Referring now to FIGS. 5–7, the pilot assembly 54 is shown in detail. The housing 56 of the pilot assembly 54 is preferably of a T-shaped configuration, when shown in cross section (see FIG. 6), and is preferably manufactured from cast iron. The housing 56 includes a main cylindrical member 87 having a first inlet 88, a first outlet 90 directly opposite the first inlet 88, and a second inlet 92 provided transverse to a longitudinal axis A defined by the first inlet 88 and the first outlet 90. Such a T-shaped housing 56 is readily commercially available and typically includes a plurality of female threads in each of the first inlet 88, first outlet 90, and second inlet 92 to facilitate attachment to other conduits.

The spark rod 58 is connected to the first inlet 88. The spark rod 58 includes a bushing 94 adapted to fit within the first inlet 88 to enable the spark rod 58 to be secured to the housing 56. A conductor 98 passes through an outer insulated sheath 100 and terminates in a retention plate 102 having a substantially circular shape that is shown best in FIG. 7.

As shown is FIG. 2, the gas supply 60 is adapted to be connected to the second inlet 92. Accordingly, gas passes through the second inlet 92, into a central chamber 106, and subsequently into a combustion chamber 108. The combustion chamber 108 preferably includes a first zone 110 having a first diameter a, and a second zone 112 having a second diameter $\beta$. In the depicted embodiment of FIG. 2, the second diameter $\beta$ is less than the first diameter $\alpha$, but it is to be understood that in alternative embodiments, the first diameter a may be greater than, or equal to, the second diameter $\beta$. By positioning the spark rod 58 within the housing 56 as described, a spark gap 114 is created between a circumferential surface 116 of the retention plate 102, and an inner surface 118 of the first zone 110. As shown in FIG. 7, the spark gap 114 is annular in shape in that it extends around the entire circumference of the retention plate 102.

In operation, the pilot assembly 24 is ignited by energizing the motor 24 and supplying combustible gas through the gas supply line 60 and into the combustion chamber 108. When the motor 24 is energized, the fan connected thereto is caused to rotate within the housing 22, which in turn directs a stream of air through the sleeve 26. At the same time, the spark rod 58 is energized, which creates a sufficient voltage differential between the outer circumference 118 of the retention plate 102 and the inner circumference 118 of the first zone 110 such that a current flow arcs or jumps across the spark gap 114, thereby igniting the gas. By providing the circumferential spark gap 114, improved reliability and starting is provided over conventional spark plugs and rods which provide smaller, non-circumferential gaps. Moreover, the pilot assembly 54 is manufactured from a low cost, readily available, components enabling the overall cost of the pilot assembly 54 to be maintained at a low level.

Once the pilot assembly 54 is ignited, the overall burner 20 can be ignited by providing gas through the main supply conduit 34. This is typically accomplished by opening a valve 120 (see FIG. 1) at an upstream end of the conduit 36. Ignition of the pilot assembly 54 is verified by the flame sensing rod 48 and the controller 50 prior to opening of the valve 120.

Figure 3:
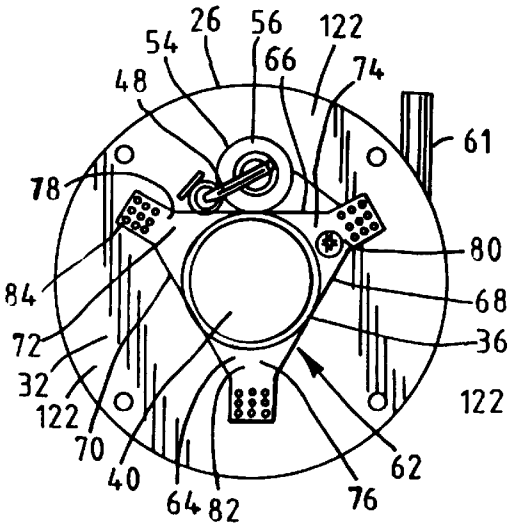
FIG.3 is a end view of FIG. 2.

Referring to FIG. 3, one of ordinary skill in the art will recognize that the retention plate 62 occupies a relatively small cross sectional area of the sleeve 26, and preferably less than fifty percent of the cross-sectional area of the sleeve 26. Major air passageways 122 are provided between adjacent spokes 78, 80, 82 wherein the retention plate 62 does not block the sleeve 26. Accordingly, a relatively large volume of air can be forced by the motor 24 and fan through the major air passageways 122 and into the combustion chamber 32. The overall output of the burner 20, in terms of BTUs, is therefore greatly improved over typical burners of comparable size which typically include a circular retention plate substantially blocking the majority of the sleeve 26.

By providing the retention plate 62 in a hub and spoke configuration, greater control over the resulting flame is provided, thereby improving flame stability. More specifically, the air flow created by the motor 24 is forced not only through the major air passageways 122, but through the minor air passageways defined by the apertures 84 in each of the spokes 78, 80, and 82. This in turn creates three stabilizing air flow paths tending to define an outer boundary for the resulting flame. Not only is the flame stabilized, but the flame is also centralized by such a retention plate 62 which in turn increases the overall BTU output burner 20.

Figure 8:
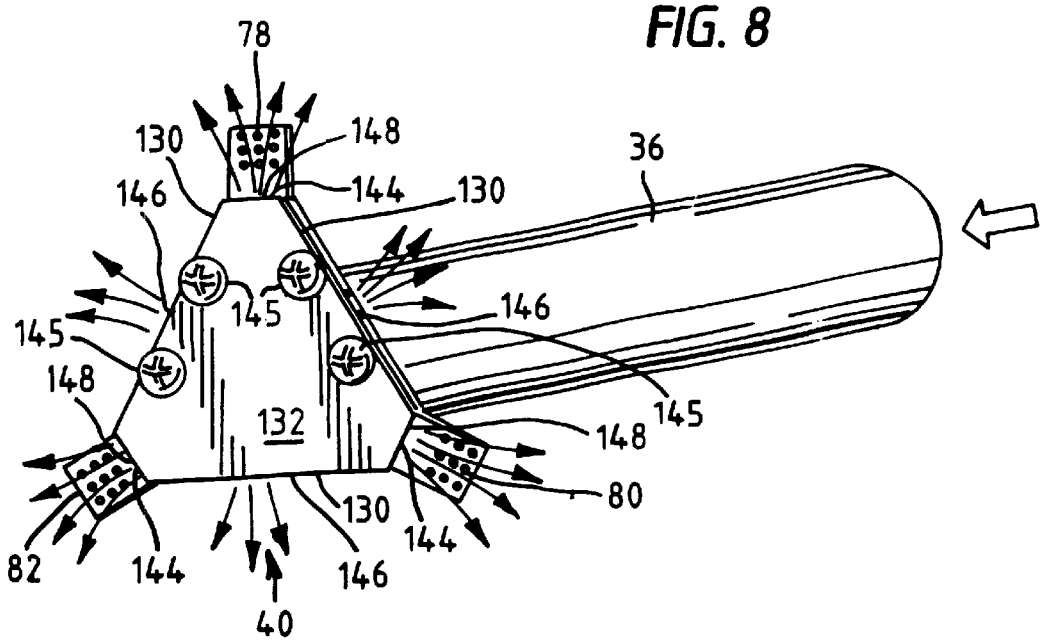
FIG. 8 is an isometric view of an alternative embodiment for a gas outlet cap constructed in accordance with the teachings of the invention.
Figure 9:
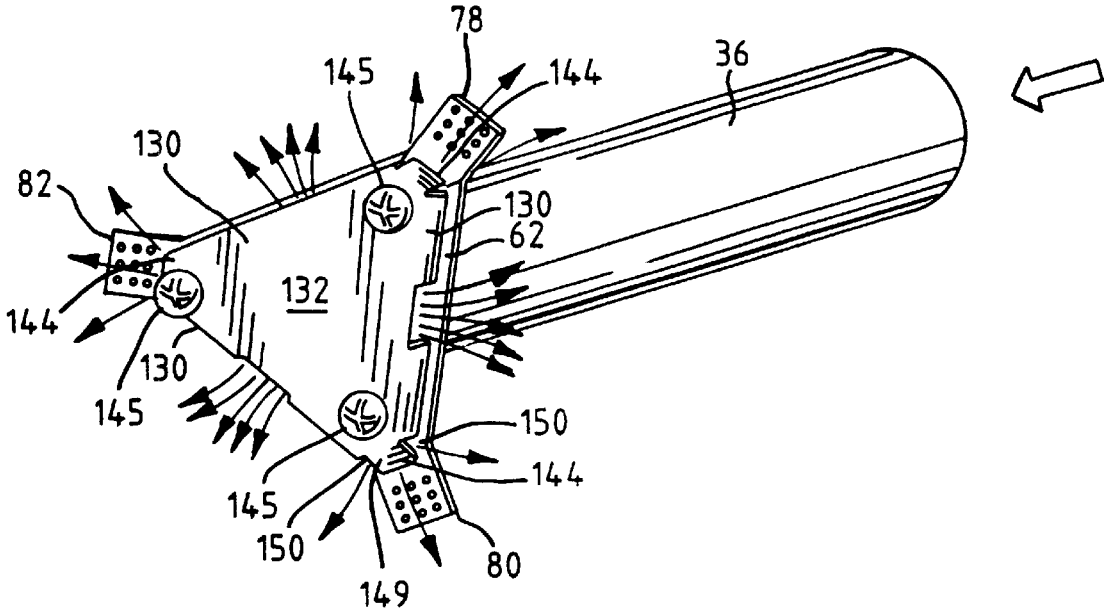
FIG. 9 is an isometric view of another alternative embodiment for a gas outlet cap constructed in accordance with the teachings of the invention.

FIGS. 8 and 9 depict alternative embodiments for the burner outlet 40. In both embodiments the outlet cap 40 is substantially triangular in shape to conform to the shape of the retention plate 62. More specifically, the outlet cap 40 includes three sides 130 surrounding a triangular body 132. The outlet cap 40 also includes three truncated corners 144, with one of the truncated corners 144 positioned proximate each one of the spokes 78, 80, 82 of the retention plate 62. The outlet cap 40 is secured to the retention plate 62 with fasteners 145. The caps 40 create distinct gas flow dispersion patterns to facilitate operation and tailor the burner 20 to a given application.

In FIG. 8, a gas outlet 146 is centrally provided in each of the three sides 130. A gas outlet 148 is provided in each of the truncated corners 144 as well. Each of the gas outlets 148 in the truncated corners 144 is larger than each of the gas outlets 146 in each of the sides 130.

In FIG. 9, each truncated corner 144 includes a flap 149 which forms multiple gas outlets 150. One gas outlet 152 is provided in each of the sides 130. Each of the gas outlets 152 in the sides 130 is substantially larger than the gas outlets 150 in the truncated corners 144.

From the foregoing, one of skill in the art will recognize that the invention provides a burner with enhanced BTU output and flame stability, while doing so at a relatively low cost.

What is claimed is:

1. A pilot assembly, comprising:

a housing having a combustion chamber, the housing being a T-shaped fitting having a main cylindrical member having first and second opposed openings, and a third opening transverse to an axis defined by the main cylindrical member;

a spark rod having an end plate disposed in the combustion chamber and spaced from an interior surface of the combustion chamber to form a spark gap around the end plate, the spark rod being connected to the first opening, the combustion chamber being formed in the second opening and a gas supply inlet in fluid communication with the combustion chamber, the gas supply inlet being formed by the third opening.

2. The pilot assembly of claim 1, wherein the combustion chamber is substantially cylindrical and the end plate is substantially circular.

3. The pilot assembly of claim 1, wherein the combustion chamber includes a first diameter proximate the end plate, and second smaller diameter proximate an outlet of the housing.

4. The pilot assembly of claim 1, wherein the T-shaped fitting is made of cast iron with the first, second, and third openings internal threads.

* * * * *